US006158198A

United States Patent [19]

Faircloth et al.

[11] Patent Number: 6,158,198

[45] Date of Patent: Dec. 12, 2000

[54] METHOD OF FORMING A COMPOSITE FOLDED HOSIERY PRODUCT AND PACKAGE

[75] Inventors: Michael Faircloth, Winston-Salem; Reid London, Clemmons, both of N.C.

[73] Assignee: Sara Lee Corporation, Winston-Salem, N.C.

[21] Appl. No.: 09/313,242

[22] Filed: May 17, 1999

[51] Int. Cl.[7] ..... B65B 63/04

[52] U.S. Cl. ..... 53/429; 493/938; 223/37

[58] Field of Search ..... 53/117, 429; 493/938; 223/37

[56] References Cited

U.S. PATENT DOCUMENTS

| | | | |
|---|---|---|---|
| 2,400,475 | 5/1946 | Tong et al. | 223/37 |
| 3,742,676 | 7/1973 | Lawing et al. | 53/429 |
| 3,750,916 | 8/1973 | Stringer et al. | 53/117 X |
| 3,902,300 | 9/1975 | Glaze | 53/429 |
| 3,905,593 | 9/1975 | Behn | 493/458 X |
| 4,379,384 | 4/1983 | Nishikawa | 53/429 X |
| 4,543,768 | 10/1985 | Nishikawa et al. | 53/571 X |
| 4,720,090 | 1/1988 | Ganno et al. | 53/117 X |
| 5,230,202 | 7/1993 | Propach et al. | 53/429 |
| 5,540,647 | 7/1996 | Weiermann et al. | 223/37 X |
| 5,996,861 | 12/1999 | Propach | 223/37 |

*Primary Examiner*—Linda Johnson
*Attorney, Agent, or Firm*—Charles Y. Lackey; Kilpatrick Stockton LLP

[57] ABSTRACT

A method of folding extended and substantially flat hosiery products with paper, with or without an insert, to produce a composite folded hosiery product suitable for packaging. Product and paper are successively folded upon themselves and thereafter positioned within an encompassing envelope, such as a poly bag or cardboard package. The insert may be introduced into the composite folded hosiery product at the first fold if it is desired in the final package.

8 Claims, 5 Drawing Sheets

METHOD OF FORMING A COMPOSITE FOLDED HOSIERY PRODUCT AND PACKAGE

BACKGROUND OF THE INVENTION

1. Field of the Invention

The present invention relates to folding substantially flat hosiery products with other package-enhancing materials and, more particularly, to a method of forming a composite folded hosiery product made up of the hosiery product and a paper segment with or without an insert suitable for packaging, including packaging the composite product.

2. Description of the Prior Art

Hosiery products, such as ladies' fine denier stockings and pantyhose, traditionally have been packaged by manually folding the extended garment with two or more folds, usually about an insert, a rather firm supporting element such as a sheet of cardboard or poly film. The folded garment and insert are then manually positioned within a thin box having a body portion and lid or a cardboard envelope which is sealed at one end by a flap. This technique, while resulting in attractive packaging, is time-consuming, inefficient, and costly. Moreover, manually handling the fine denier delicate fabric can result in picks and snags, thus damaging the garment and requiring its replacement.

Various machines have been developed to package hosiery automatically and semi-automatically principally in the sock industry where the fabric of the garments is more durable and where the product itself is significantly smaller and thus easier to handle automatically with appropriately designed machines. This type of packaging equipment usually utilizes a plunger to cause the insertion of the final folded product into the receiving package, most commonly a three-dimensional rectangular box which can thereafter be sealed at one end. While this procedure is acceptable for socks and the heavier denier hosiery products, it has not been successfully used to a great extent with fine denier fashion hosiery and pantyhose.

A significant amount of ladies' hosiery products has been packaged successfully with machinery when the garments are not boarded and thus remain in a crumpled, rather small configuration. Hosiery products sold under the trademark L'EGGS over the years which are placed in egg-like packages by automatic machinery are a principal example. In these packages, it is not usually possible to see the fabric of the garment prior to purchase, since there is no window in the package. Product selection is done by fabric samples positioned on or near the display from which the product is dispensed.

Currently, consumers prefer to purchase top-quality fine denier ladies' hosiery and pantyhose that have been boarded; i.e., stretched over a boarding frame and subjected to heat so that the fabric is smooth, unwrinkled, and easily viewed by a potential consumer, particularly when the fabric is ultimately packaged with an insert of a light color so that the knitted fabric is more distinctly presented for inspection. Thus, there is a continued need for streamlining the handling and packaging of such products in a more efficient and less costly manner. It is to these needs that the present invention is directed.

SUMMARY OF THE INVENTION

The present invention is directed to a method of folding a longitudinally extending and substantially flat hosiery product with a segment of substantially flat paper, such as tissue paper, with or without an insert, to form a composite folded hosiery product suitable for packaging. The method includes making a first fold in the substantially flat hosiery product and paper segment to form first and second fold portions (selectively inserting or not inserting an insert along the fold), folding one of the fold portions upon itself to form a folded first fold portion, folding the second fold portion upon itself to form a folded second fold portion, and folding the folded first fold portion and the folded second fold portion upon themselves to form a composite folded hosiery product suitable for packaging. This folded hosiery product can thereafter be inserted into a receiving envelope, such as a polyethylene bag or a formal cardboard package.

From the summary of the invention described, it will be apparent that a primary objective is to provide a highly efficient method of folding substantially flat (boarded or semi-boarded) hosiery products with segments of substantially flat paper, utilizing or not utilizing, as desired, an insert.

Another object of the present invention is to provide a method of the type described that will minimize damage to the product during the packaging operation.

A further objective of the present invention is to provide a method of the type described that will substantially decrease the time of the packaging operation and thereby significantly increase production efficiency.

Thus, there has been outlined the more important features of the invention in order that the detailed description that follows may be better understood and in order that the present contribution to the art may be better appreciated. There are, of course, additional features of the invention that will be described hereinafter which will form the subject matter of the claims appended hereto. In this respect, before explaining at least one embodiment of the invention in detail, it is to be understood that the invention is not limited in its application to the arrangement of the components set forth in the following description or illustrated in the drawings. The invention is capable of other embodiments and of being practiced and carried out in various ways.

It is also to be understood that the phraseology and terminology employed herein are for the purpose of description and should not be regarded as limiting. As such, those skilled in the art will appreciate that the concept upon which this disclosure is based may readily be utilized as a basis for designing other structures, methods, systems, and in carrying out the several purposes of the present invention. It is important that the claims be regarded as including such equivalent methods and products resulting therefrom so long as they do not depart from the spirit and scope of the present invention. The application is neither intended to define the invention which is measured by its claims nor to limit its scope in any way.

For a better understanding of the invention, its operating advantages, and the specific results obtained by its use, reference should be made to the following detailed description taken in conjunction with the accompanying drawings wherein like characters are referenced to designate like parts throughout the several views.

DETAILED DESCRIPTION OF PREFERRED EMBODIMENTS

Figure 1:
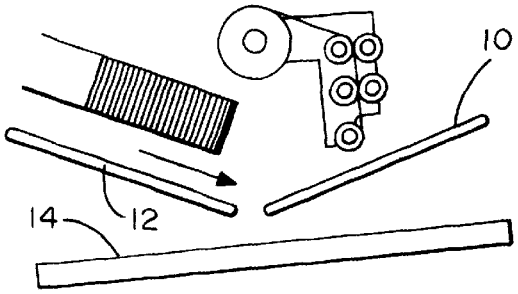
FIGS. 1(*a*)–1(*j*) is a sequence of schematic views of the process comprising the present invention beginning with the placement of a flat hosiery product followed by the placement of a segment of paper and an insert contiguous therewith, wherein the completion of the process results in a composite folded hosiery product, paper segment, and insert which is suitable for packaging.
Figure 1:
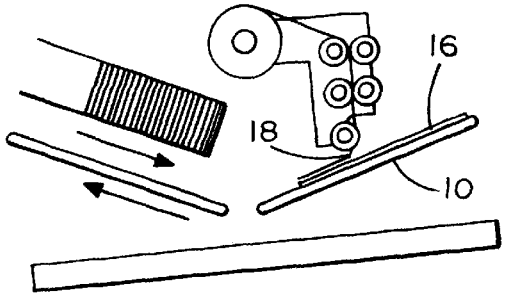
Figure 1:
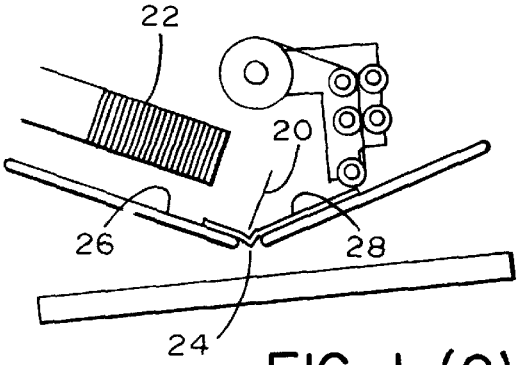
Figure 1:
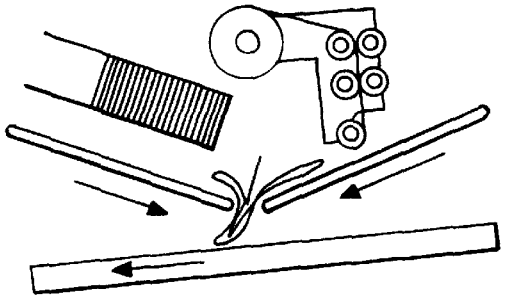
Figure 1:
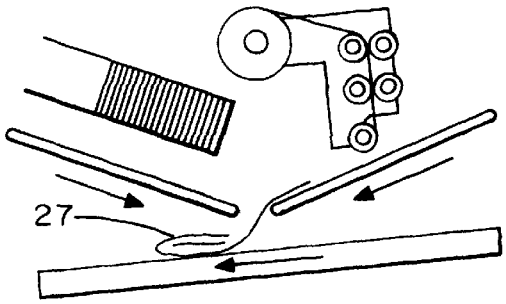
Figure 1:
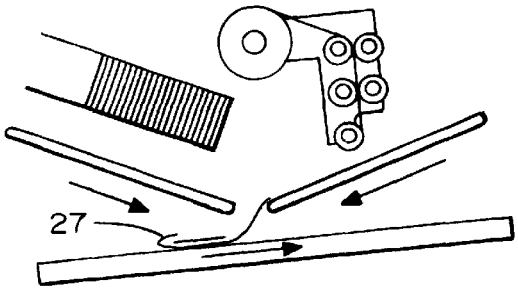
Figure 1:
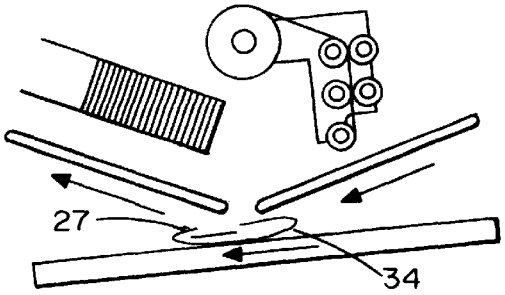
Figure 1:
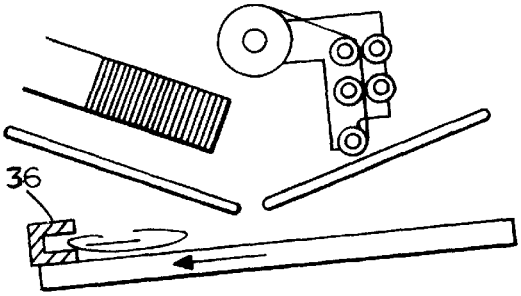
Figure 1:
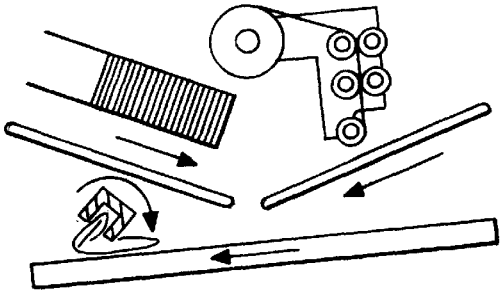
Figure 1:
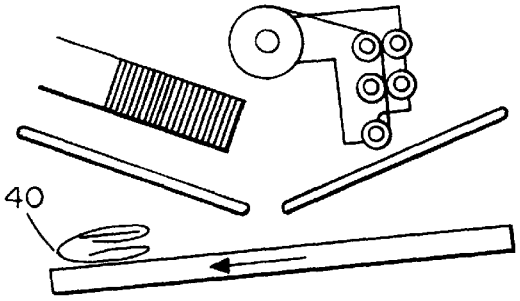

Referring now to FIG. 1, and particularly FIG. 1(*a*), a first conveyor 10 cooperates with a second conveyor 12 and a third conveyor 14 to automatically practice the method of the present invention, which will be subsequently described. With more particularity, a longitudinally extended substantially flat hosiery product 16 (FIG. 1(*b*)) moves down conveyor 10 and is joined by a segment of substantially flat paper 18 and thereafter moves with hosiery product 16. Both product 16 and paper segment 18 move downwardly along conveyor 10 until they engage conveyor 12 moving upwardly as shown in FIG. 1(*c*). Conveyor 12 moves downwardly (see arrow) so that when insert 20 is ejected from insert reservoir 22 to engage segment 18 and product 16, a fold 24 is produced, thus creating a first fold portion 26 and a second fold portion 28.

Once fold 24 is created, the folded product 16, paper segment 18, and insert 20 move between conveyors 10 and 12 as shown in FIG. 1(*d*) onto conveyor 14 to move in another direction (see arrow).

When first fold portion 26 engages conveyor 14, it moves for a predetermined distance until all of first fold portion 26 has passed beyond conveyor 12 and folded upon itself (see FIG. 1(*e*)) to form folded first fold portion 27. Conveyor 14 then reverses direction and folded first fold portion 27 is reversed and moves under conveyor 10 thereby causing second fold portion 28 to fold upon itself (see FIG. 1(*g*)) to form a folded second fold portion 34.

Folded first fold portion 27 and folded second fold portion 34 thereafter move in an earlier direction (see arrow) to engage a folding member 36 which folds folded second fold portion 34 over folded first portion 27 to form a composite folded hosiery product, paper segment, and insert 40 suitable for packaging.

Figure 4:
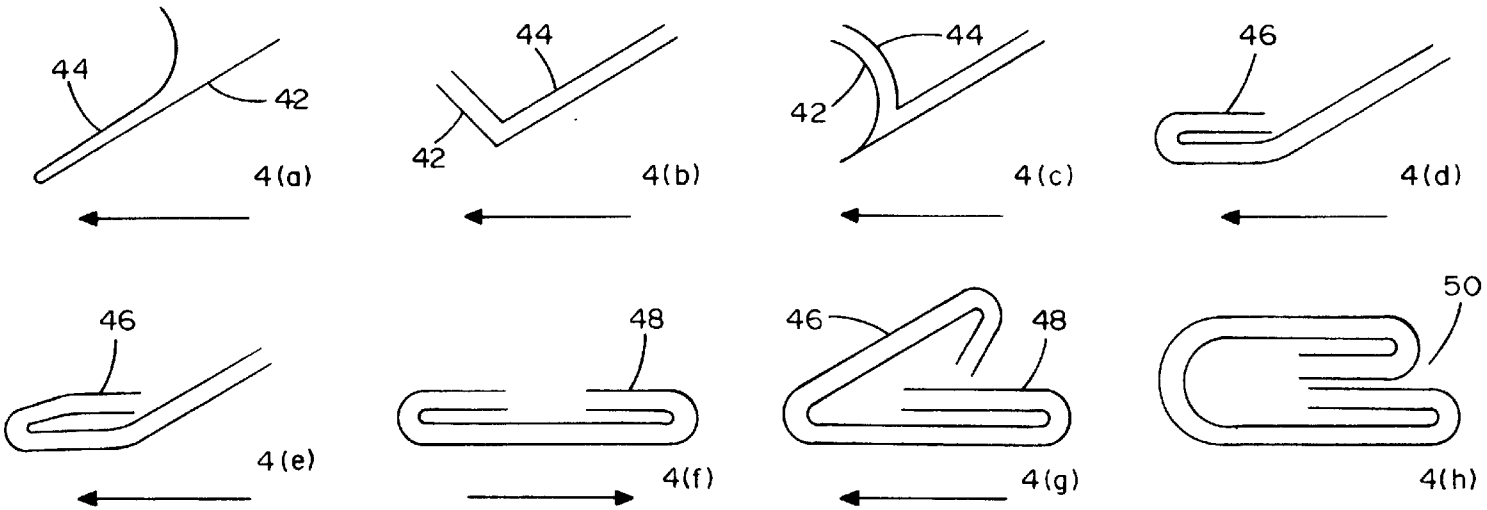
FIGS. 4(*a*)–4(*h*) is a sequence of schematic views illustrating a segment of a substantially flat paper being positioned against a flat hosiery product and thereafter manipulated to form a composite folded hosiery product and paper segment suitable for packaging.
Figure 3:
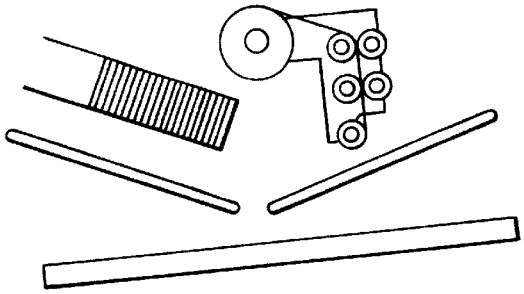
FIGS. 3(*a*)–3(*j*) is a sequence of schematic views illustrating the process comprising the present invention wherein the hosiery product and segment of paper are packaged without an insert.
Figure 3:
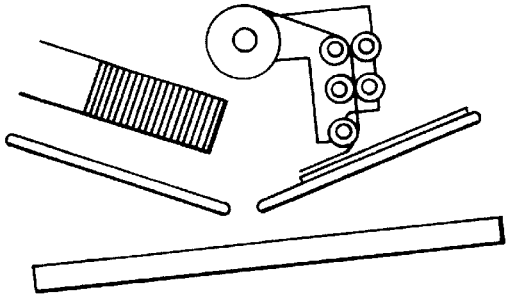
Figure 3:
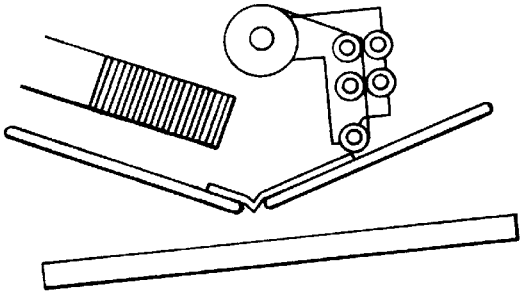
Figure 3:
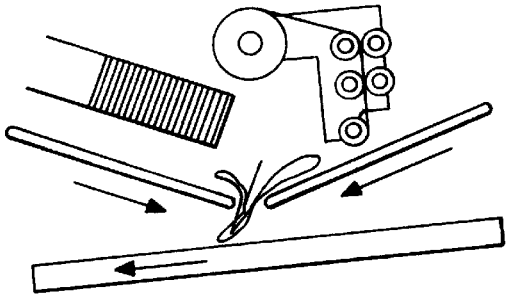
Figure 3:
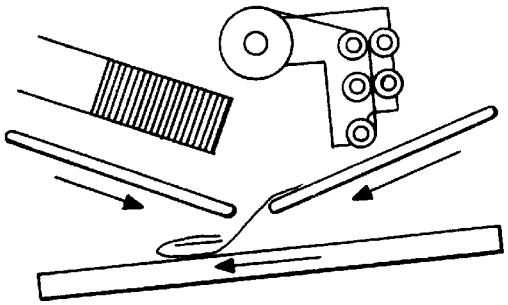
Figure 3:
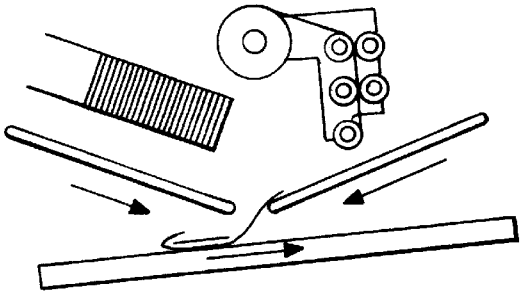
Figure 3:
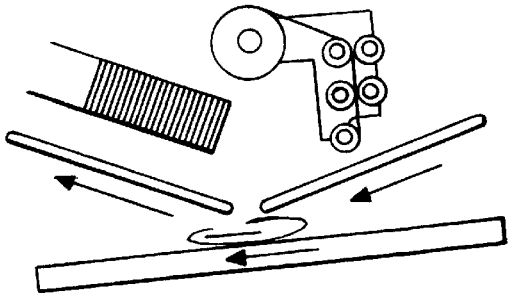
Figure 3:
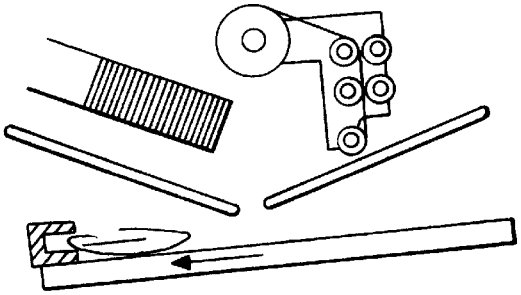
Figure 3:
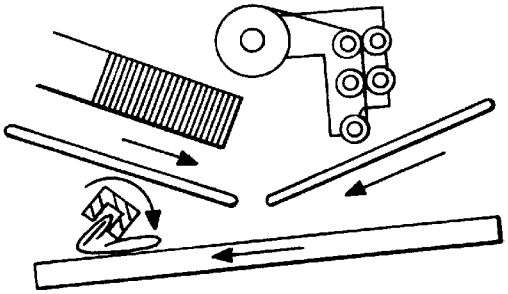
Figure 3:
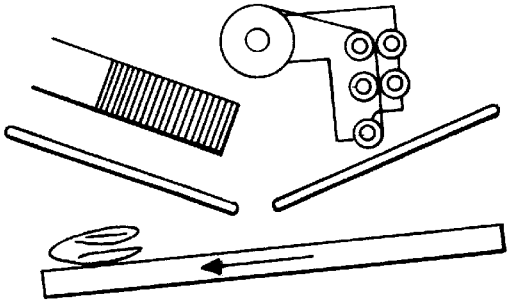

While traditionally flat hosiery packages have included an insert to give the package stability and to convey information concerning the product, it has been found acceptable to eliminate the insert, particularly when product information can be imprinted on the surface of the package itself. The method of the present invention is equally applicable to packaging hosiery products that do not include an insert, but that do include a segment of paper, particularly a tissue-like paper, that suggests elegance and quality. The process works essentially the same, except that insert 20 is eliminated and the steps of the process are therefore set forth with particularity in FIG. 3. A more specific illustration of the formation of a composite folded hosiery product and paper segment is shown in FIG. 4 wherein FIG. 4(*a*) shows the joining of a hosiery product 42 with a segment of substantially flat paper 44. Product 42 and paper 44 are folded in FIG. 3(*b*) and are thereafter urged downwardly (FIG. 4(*c*)) so that a folded first fold portion 46 is formed as shown in FIG. 4(*d*). Folded first fold portion 46 continues to move (FIG. 3(*e*)) as shown and movement direction is reversed so that a folded second fold portion 48 is produced as shown in FIG. 3(*f*).

Movement direction is again reversed and folded first fold portion 46 is folded over folded second fold portion 48 as shown in FIG. 4(*g*). The result is the formation of a composite folded hosiery product suitable for packaging, such as shown in FIG. 4(*i*) and generally designated as 50.

The method described lends itself to several variations utilizing a combination of conveyors to achieve automated operation. The examples illustrated herein are operable ones most efficiently utilized to accomplish the desired objective. Obviously, other embellishments can be incorporated utilizing the method of the present invention, including the addition of additional materials within the composite package and the revision of fanciful packaging that will have quality consumer appeal.

Figure 2:
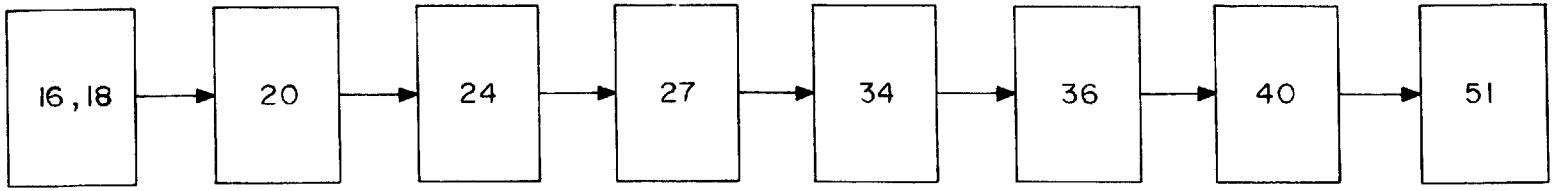
FIG. 2 is a block diagram showing the steps of the process comprising the present invention, including the placement of the final package of composite folded hosiery product, paper segment, and insert into a suitable receptacle.

The method disclosed herein provides a technique for conditioning hosiery products with other elements or components into an arrangement that can be cooperatively received by a package 51 (FIG. 2). The package can be an envelope of appropriate material, a traditional cardboard box, a multiple garment package, or a discretionary accumulation of hosiery products to be displayed in a bin for mass distribution.

The techniques involved in conforming the novel process set forth in the present inventive concept and the components associated therewith are unlimited and are deemed readily apparent and obvious to one skilled in the art. All equivalent relationships to those illustrated in the drawings and described in the specification are intended to be encompassed herein. Consequently, the following is considered as illustrative only of the principles of the invention. Since numerous modifications and changes will readily occur to those skilled in the art, it is not desired to limit the invention to the exact construction and operation shown and described. All suitable modifications and equivalents falling within the scope of the appended claims are deemed within the present inventive concept.

What is claimed is:

1. A method of folding a longitudinally extended substantially flat hosiery product with a segment of substantially flat paper and an insert utilizing at least two conveyors, the method comprising the steps of:

moving the hosiery product on a conveyor along a predetermined path of travel in a first direction;

positioning the paper segment against the hosiery product as the hosiery product moves in the first direction;

positioning an insert against the paper segment and hosiery product to create a fold and form a first fold portion and a second fold portion;

positioning the first fold portion against another conveyor to move the first fold portion in another direction and cause the first fold portion to fold upon itself and form a folded first fold portion;

reversing the movement of the folded first fold portion and second fold portion to cause the second fold portion to fold upon itself and form a folded second fold portion;

reversing the direction of movement of the folded first fold portion and the folded second fold portion; and folding the folded second fold portion over the folded first fold portion to form a composite folded hosiery product, paper segment, and insert suitable for packaging.

2. A method of folding a longitudinally extending and substantially flat hosiery product with a segment of substantially flat paper and an insert comprising the steps of:

moving the hosiery product along a predetermined path of travel in a first direction;

positioning the flat paper against and along the hosiery product;

positioning an insert against the paper segment and hosiery product to create a fold and form a first fold portion and a second fold portion;

moving the first fold portion in another direction to cause the first fold portion to fold upon itself and form a folded first fold portion;

reversing the movement of the folded first fold portion and the second fold portion to cause the second fold portion to fold upon itself and form a folded second fold portion; and folding the folded first fold portion over the folded second fold portion to form a composite folded hosiery product suitable for packaging.

3. A method of folding a longitudinally extended substantially flat hosiery product with a segment of substantially flat paper utilizing at least two conveyors, the method comprising the steps of:

moving the hosiery product on a conveyor along a predetermined path of travel in a first direction;

positioning the paper segment against the hosiery product as the hosiery product moves in the first direction;

creating a fold in the hosiery product and paper segment to form a first fold portion and a second fold portion;

positioning the first fold portion against another conveyor to move the first fold portion in another direction and cause the first fold portion to fold upon itself and form a folded first fold portion;

reversing the movement of the folded first fold portion and second fold portion to cause the second fold portion to fold upon itself and form a folded second fold portion;

reversing the direction of movement of the folded first fold portion and the folded second fold portion; and folding the folded second fold portion over the folded first fold portion to form a composite folded hosiery product and paper segment suitable for packaging.

4. A method of folding a longitudinally extending and substantially flat hosiery product with a segment of substantially flat paper comprising the steps of:

moving the hosiery product along a predetermined path of travel in a first direction;

positioning the flat paper against and along the hosiery product;

creating a fold to form a first fold portion and a second fold portion;

moving the first fold portion in another direction to cause the first fold portion to fold upon itself and form a folded first fold portion;

reversing the movement of the folded first fold portion and the second fold portion to cause the second fold portion to fold upon itself and form a folded second fold portion; and folding the folded first fold portion over the folded second fold portion to form a composite folded hosiery product suitable for packaging.

5. The method as claimed in claim 1 further comprising positioning the composite folded hosiery product within a compatible receptacle.

6. The method as claimed in claim 2 further comprising positioning the composite folded hosiery product within a compatible receptacle.

7. The method as claimed in claim 3 further comprising positioning the composite folded hosiery product within a compatible receptacle.

8. The method as claimed in claim 4 further comprising positioning the composite folded hosiery product within a compatible receptacle.

* * * * *